US006572069B1

(12) United States Patent
Kotthaus

(10) Patent No.: US 6,572,069 B1
(45) Date of Patent: Jun. 3, 2003

(54) RELEASABLE FASTENING DEVICE

(76) Inventor: Hans Kotthaus, Nilsabakken 6, Ålgård N-4330 (NO)

( * ) Notice: Subject to any disclaimer, the term of this patent is extended or adjusted under 35 U.S.C. 154(b) by 0 days.

(21) Appl. No.: 10/110,153

(22) PCT Filed: Oct. 4, 2000

(86) PCT No.: PCT/NO00/00328

§ 371 (c)(1),
(2), (4) Date: Apr. 9, 2002

(87) PCT Pub. No.: WO01/26513

PCT Pub. Date: Apr. 19, 2001

(30) Foreign Application Priority Data

Oct. 14, 1999 (NO) ..... 19994989

(51) Int. Cl.[7] ..... A47G 33/12; F16M 13/00
(52) U.S. Cl. ..... 248/523; 248/521; 47/40.5
(58) Field of Search ..... 248/523, 524, 248/525, 526, 521, 522; 47/40.5

(56) References Cited

U.S. PATENT DOCUMENTS

| | | | | |
|---|---|---|---|---|
| 2,891,747 A | * | 6/1959 | Steede | 47/40.5 |
| 3,058,707 A | * | 10/1962 | Lego | 248/524 |
| 3,301,512 A | * | 1/1967 | Nyberg | 248/524 |
| 3,302,909 A | * | 2/1967 | Glassman | 47/40.5 |
| 4,834,335 A | * | 5/1989 | Attar | 248/526 |
| 4,949,502 A | | 8/1990 | Anderson | 47/40.5 |
| 4,989,820 A | | 2/1991 | Sterling | 248/523 |
| 5,464,186 A | * | 11/1995 | Robert | 248/524 |
| 5,507,117 A | | 4/1996 | Kalman et al. | 47/40.5 |
| 5,918,849 A | * | 7/1999 | Bliss | 248/523 |

FOREIGN PATENT DOCUMENTS

| | | | |
|---|---|---|---|
| EP | 369 633 | | 5/1990 |
| GB | 1 589 257 | | 5/1981 |
| GB | 2208591 A | * | 4/1989 |
| WO | 97/21372 | | 6/1997 |

* cited by examiner

*Primary Examiner*—Ramon O. Ramirez
*Assistant Examiner*—Jon Szumny
(74) *Attorney, Agent, or Firm*—Andrus, Sceales, Starke & Sawall, LLP

(57) ABSTRACT

The invention regards a releasable fastening device for an object (40) that in the fastening area for a base (10) is bar-shaped and has a cross section with a round or non-round peripheral shape, e.g. a Christmas tree. When fastening, the object (40) is inserted into an opening (18) between one or several resilient clamping parts (34) that are equipped with e.g. teeth or barbs against the object (40), and further into a centring point (20) at the lower end of the opening (18). The clamping part(s) (34) are rotatably or non-rotatably attached to the periphery of an annular element (28), and each clamping part is preferably rotatable or resilient in the radial direction of the opening (18). In the opening (18), the annular element (28) abuts a preferably circular and horizontal abutment surface (26) in the wall (24) of the opening (18). When releasing, the object (40) is rotated about the longitudinal axis of the opening (18) until the clamping part(s) (34) align with the corresponding recess(es) or enlarged portion(s) (22) of the wall (24). By so doing, the clamping part(s) (34) are released from the object (40) and fall outwards through the recess(es) or the enlarged portion(s) (22), and the object (40) may be removed.

9 Claims, 9 Drawing Sheets

RELEASABLE FASTENING DEVICE

CROSS REFERENCE TO RELATED APPLICATION

The present application is the U.S. national stage application of International Application PCT/NO00/00328, filed Oct. 4, 2000, which international application was published on Apr. 19, 2001 as International Publication WO 01/26513. The International Application claims priority of Norwegian-.Patent Application No. 19994989, filed Oct. 14, 1999.

THE AREA OF THE INVENTION

This invention regards a releasable fastening device for an object that in the fastening area is bar-shaped and has a cross section with a round or non-round peripheral shape, e.g. a Christmas tree, a square fence post or a candle. The invention is initially intended for, but not limited to, a vertically or approximately vertically upright item, e.g. a Christmas tree.

PRIOR ART

There are several known fastening devices for bar-shaped objects in existence. In some cases, the object is fastened in a cylindrical holder/socket by means of screws that are screwed into the object.

In another case, described in DE 19545787, the object is fastened in a cylindrical socket that has been split lengthwise into two parts of identical size, where the two semi-cylindrical parts are hinged together on one side. The object is then placed between the parts, whereupon these are closed and locked, e.g. with a locking pin. The insides of these semi-cylindrical parts, and possibly the bottom of the fastening device, may if desired be provided with teeth, points or mouldings that bite into or grip the object in order to keep this in place.

In GB 1589257, a fastening device with fastening levers is used, which at the end is equipped with teeth or similar that bite into the object and keep it in place. At the other end, said levers are fastened, or possibly hinged, to an annular element wherein the object is placed and centred. Each lever may as an example rotate about a shaft that is attached to the annular element, so that the rotational movement occurs within an imaginary vertical plane that extends radially from the centre of the annular element. The fastening levers are provided with teeth, points or similar at the end that interacts with the object.

In U.S. Pat. No. 4,949,502 and EP 96081 the fastening levers have at the opposite end been extended past a rotational shaft, where this end is designed so as to form one of several legs upon which the object can stand. After the fastening levers have been brought into engagement with the object, the weight of the object will give the fastening levers a moment about said rotational shaft, which moment will force the legs outwards in the radial direction. At the same time, the other end of each fastening lever is forced in towards the object, keeping this clamped.

Disadvantages of Prior Art

Known devices as described above have disadvantages of a varying nature. The fastening device where the object is fastened in a cylindrical holder/socket by means of screws that are screwed into the object, e.g. a Christmas tree, often requires that one bends down, or possibly crawls underneath the object, in order to tighten or adjust the screws. The associated screw thread may also rust, for instance in connection with watering a Christmas tree. This may cause problems when fastening or loosening the screws.

The fastening device where the object is fastened in a cylindrical socket that has been split lengthwise into two parts, and where the two semi-cylindrical parts are hinged together on one side, requires that the part of the object that is fastened in the cylinder has a shape and size that fits into this.

Some of the fastening devices that keep the object in place by means of fastening levers have the disadvantage of not allowing the object to be lifted and moved without the object detaching from the fastening device.

The Object of the Invention

The object of the invention is to provide a fastening device that makes it easy to fasten and release an object with a bar-shaped fastening area and a cross section with a round or non-round peripheral shape. The invention also seeks to provide a fastening device that allows the object to be moved without detaching from the fastening device.

How to Achieve the Object/Objects

The object is achieved through the characteristics stated in the description given below and the subsequent claims. Advantages of the invention will also be seen from the description and the subsequent claims.

According to the invention, the fastening device consists of a base with an optional exterior shape, which internally consists of a cylindrical or conical through-going or not through-going opening that runs to a centring point positioned at the bottom of the base. As an alternative to a centring point, it is possible to utilise another suitable centring device in order to keep the object centred in the opening. The lower part of the base also functions as a foot, while the upper part houses a releasable fastening mechanism. The inside of the upper part of the base, which may be shaped like a collar, has been designed with said cylindrical or conical opening. This part of the base contains one or several recesses or enlarged portions of a suitable shape, which are open at the top of the base. Underneath the recess(es) or the enlarged portion(s), the wall of the opening has a circular and preferably horizontal abutment surface, on which surface is placed a separate and matching annular element.

One or several releasable clamping parts are fixed to the annular element in an appropriate manner, which parts are from now on called clamping parts and which coincide with the recess(es) or the enlarged portions(s) in the wall with regard to number and mutual angular spacing. Each clamping part may rotate or be resilient about the fastening area of the annular element, so that the rotational movement occurs within an imaginary vertical plane that runs through the fastening area and radially in towards the centre of the annular element. When fastening an object, the clamping part(s) are preferably placed over the annular element, and the clamping part(s) squeeze the object and keep it clamped.

Each clamping part is further equipped with an integrally cast or affixed outside abutment surface that abuts the inside of the wall material in order to keep the object clamped in the sideways direction. The abutment surface(s) preferably exhibit low friction, in order to allow the object to be rotated about the centreline of the opening with ease.

Each clamping part preferably exerts a spring action in relation to the object to be fastened. The free end of each clamping part that closes against the object may therefore consist of a resilient portion, e.g. a steel spring, while the remainder of the clamping part may consist of a non-resilient portion. The resilient portion may for instance be integrally cast in the clamping part, or it may be attached to this by means of a snap-in type device. The same spring action may be achieved by the resilient portion being rotatably attached to the annular element, where the non-resilient part forms the free end of the clamping part against the object. A third possibility entails the entire clamping part being a resilient portion, for example a steel spring or a resilient plastic element, which is hinged to or non-rotatably attached to the annular element.

The free end, or nose end, of the clamping part, which end upon fastening presses against the bar-shaped object, may be provided with points, teeth, barbs or any other suitable shapes that project in towards the centreline of the opening and create a back stop or an appropriate abutment surface that bites into, grips or engages the object and keeps it clamped.

In order to be able to lift and move the object together with the base, the annular element must be locked to the base in the axial direction of the opening. This may as an example be achieved through providing the annular element with a circular groove or tongue that interlocks with a corresponding tongue or groove in the wall. Additional types of locking devices may be used for this purpose, e.g. a snap-in device, a bayonet coupling or a threaded connection. Each clamping part can also be hinged centrally in the annular element, where the end of the clamping part that does not bite into the object is shaped with a gripping device that bites into, grips or engages a correspondingly shaped edge, ring, moulding or similar in an engagement area of the base, preferably in the opening of the base. In the latter case, lifting the fastened object will cause axial forces to be transferred through the clamping part to said engagement area, so that the forces do not load the hinge device of the clamping part with the annular element.

It is advantageous to all the above mentioned axial locking devices that they be formed in such a way that the annular element may easily be rotated about the centreline of the opening.

The size of the annular element, as well as the number and design of the clamping parts, will naturally place certain restrictions on potential applications with regard to the size, peripheral shape and/or material of the object. These 30 disadvantages may to a certain degree be eliminated by replacing the annular element and the associated clamping part with a corresponding annular element with e.g. a smaller inside diameter, and more or fewer clamping parts, which may also possibly be shaped differently.

When fastening an object, this is inserted into the opening towards or between one or several resilient portions, whereupon the bottom of the object is held in place e.g. by a centring point provided below the annular element, or possibly at the bottom of the base. The resilient portions are elastic, and will therefore take shape according to the peripheral shape of the object, while a back stop or a suitable abutment surface keeps the object in place in the longitudinal direction of the object. The fastening device according to the invention thereby makes it possible to lift and move an object with ease, without the base with associated fastening device detaching and falling off.

When releasing an object from the fastening device, the object is gripped while the base is kept in place, e.g. by using the foot. Then the object is rotated with the annular element and associated parts, preferably about the centreline of the opening, to a position in which the clamping part(s) align with the recess(es) or enlarged portion(s) of the wall, whereupon each clamping part and corresponding resilient portion lose their point of abutment against the wall, loosen from the object and fall outwards through the recess(es) or the enlarged portion(s). The recess(es) or the enlarged portion(s) do not necessarily have to be larger than to allow the free end/nose section, which closes against the object upon release, to move outside of the inner circumference of the annular element. After release, the object is lifted out of the opening in the base and removed.

Possible Further Development of the Invention

A further development of the invention may be to adapt the fastening device to various types of objects with regard to size, shape and types of materials. Such a releasable fastening device may also be used in a fastening device in which the object does not stand upright. Examples of this may be a releasable fastening device used as fishing rod holder in a boat, when securing a piece of wood in a lathe, or to anchor an object that is suspended from a ceiling.

SHORT DESCRIPTION OF THE DRAWINGS

In the following part of the description, two examples of embodiments of the invention will be illustrated with reference to the set of figures, but where one example is illustrated with two bases with different exterior shapes. One particular reference number refers to the same detail in all figures where this detail is featured, and where:

Figure 10A:
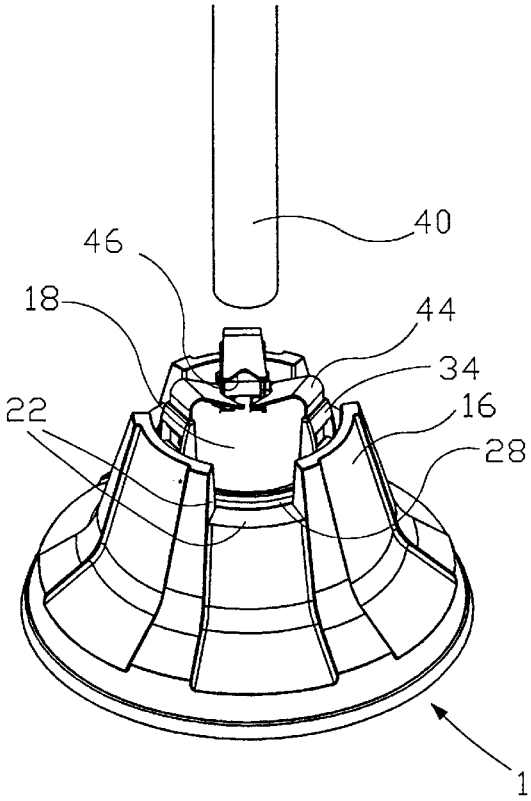
Figure 10B:
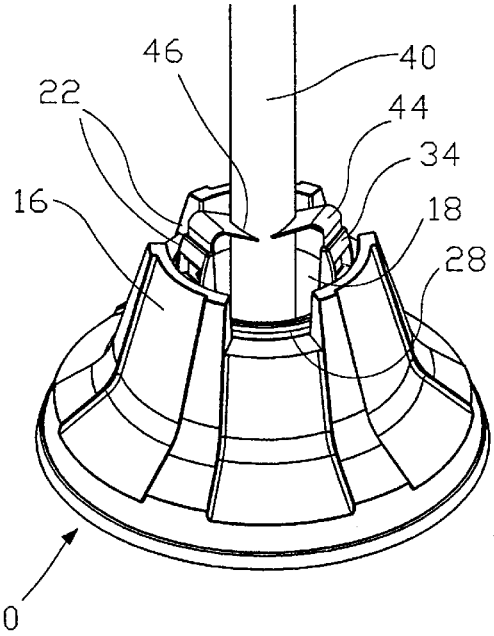
Figure 10C:
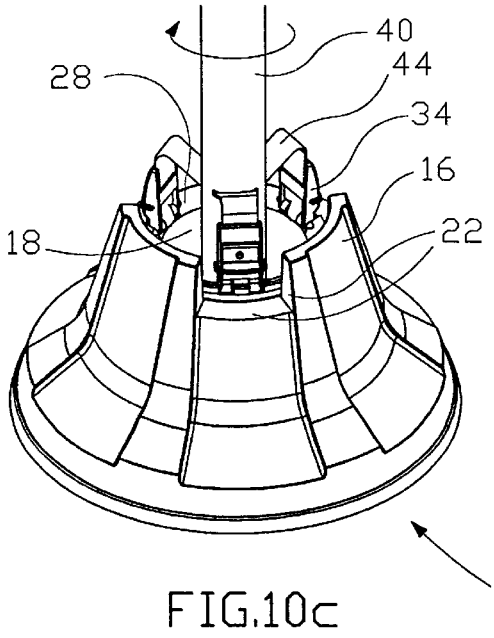
Figure 10D:
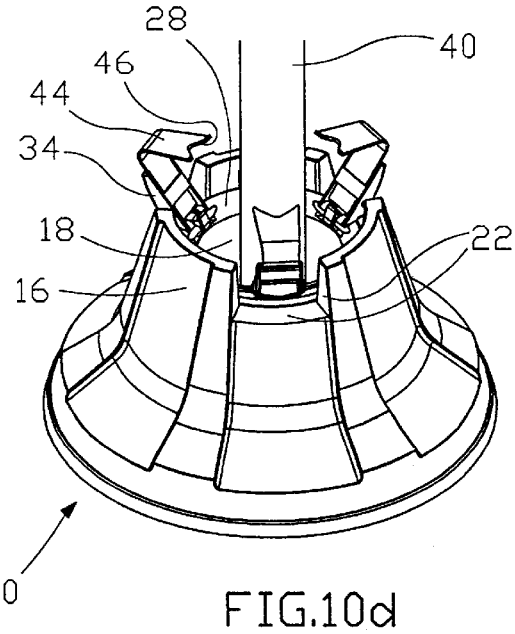
Figure 11:
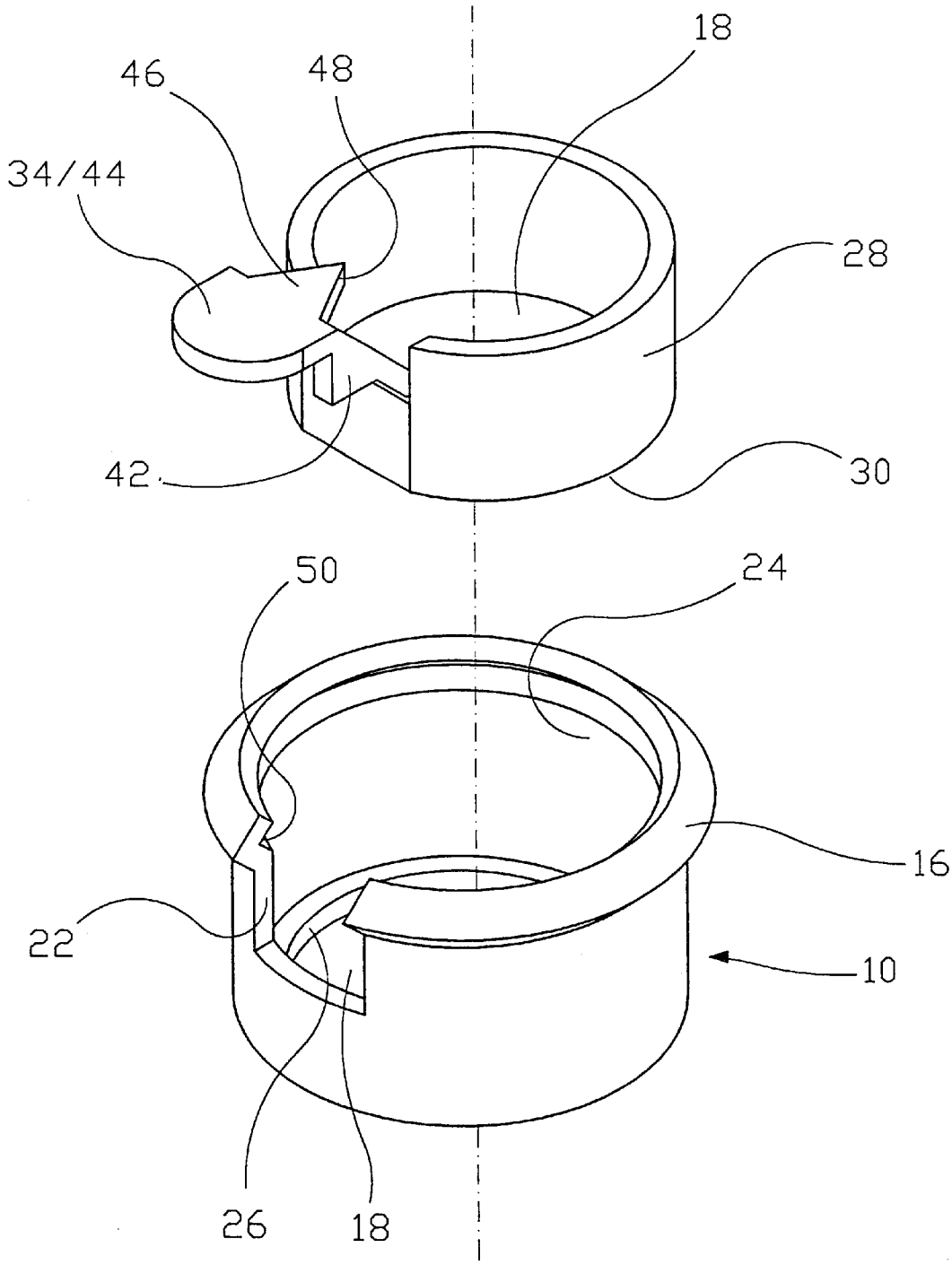
Figure 12A:
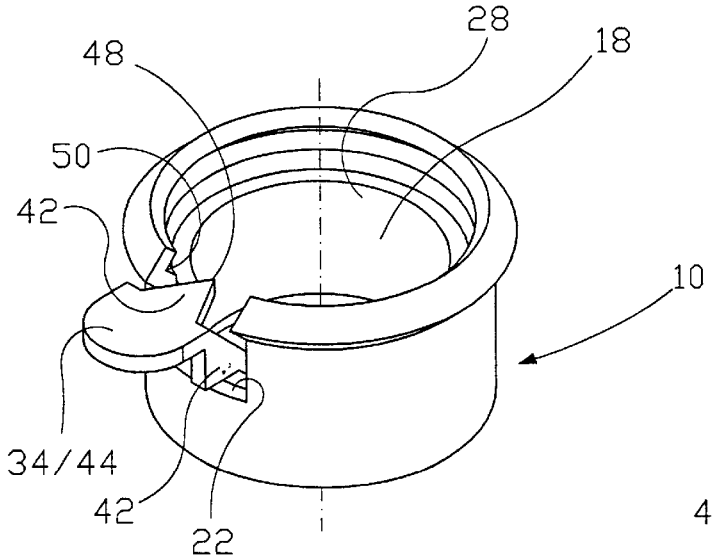
Figure 12B:
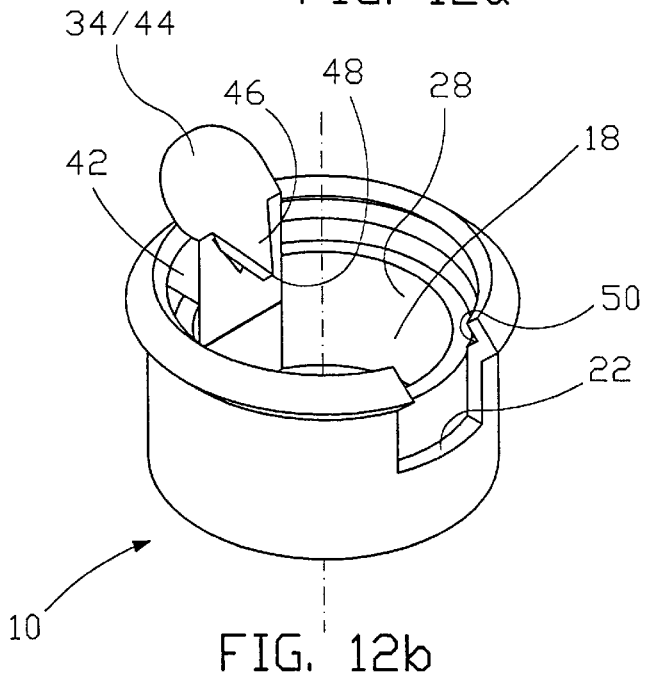
Figure 13:
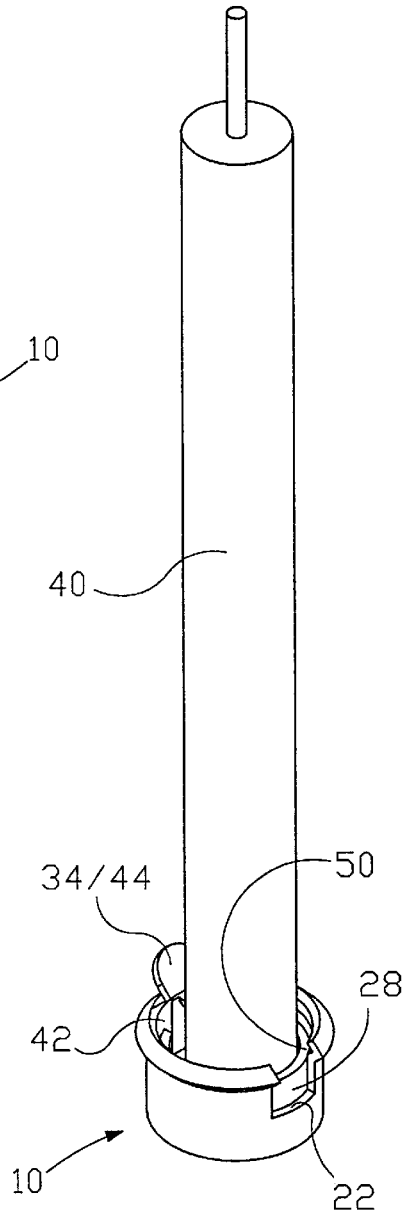

FIGS. 10*a* and 10*b* show fastening, and FIGS. 10*c* and 10*d* show release of a bar-shaped object by means of a device according to the invention. The arrows in FIG. 10*c* illustrate the object being rotated about the centreline of the base opening;

FIG. 11, seen in relation to the above figures, shows a perspective view of another example of an embodiment, where the annular element and the base are designed with one clamping part and one recess only, and where the annular element and the base are shown detached from each other;

FIGS. 12*a* and 12*b* show two perspective views of the base and the annular element assembled, where FIG. 12*a* shows the clamping part in the released position, with it projecting out through the recess, and where FIG. 12*b* shows the clamping part arranged in the base ready to fasten an object; and FIG. 13 shows a perspective view wherein a bar-shaped object in accordance with the invention is releasably fastened.

DESCRIPTION OF EMBODIMENTS

Figure 1:
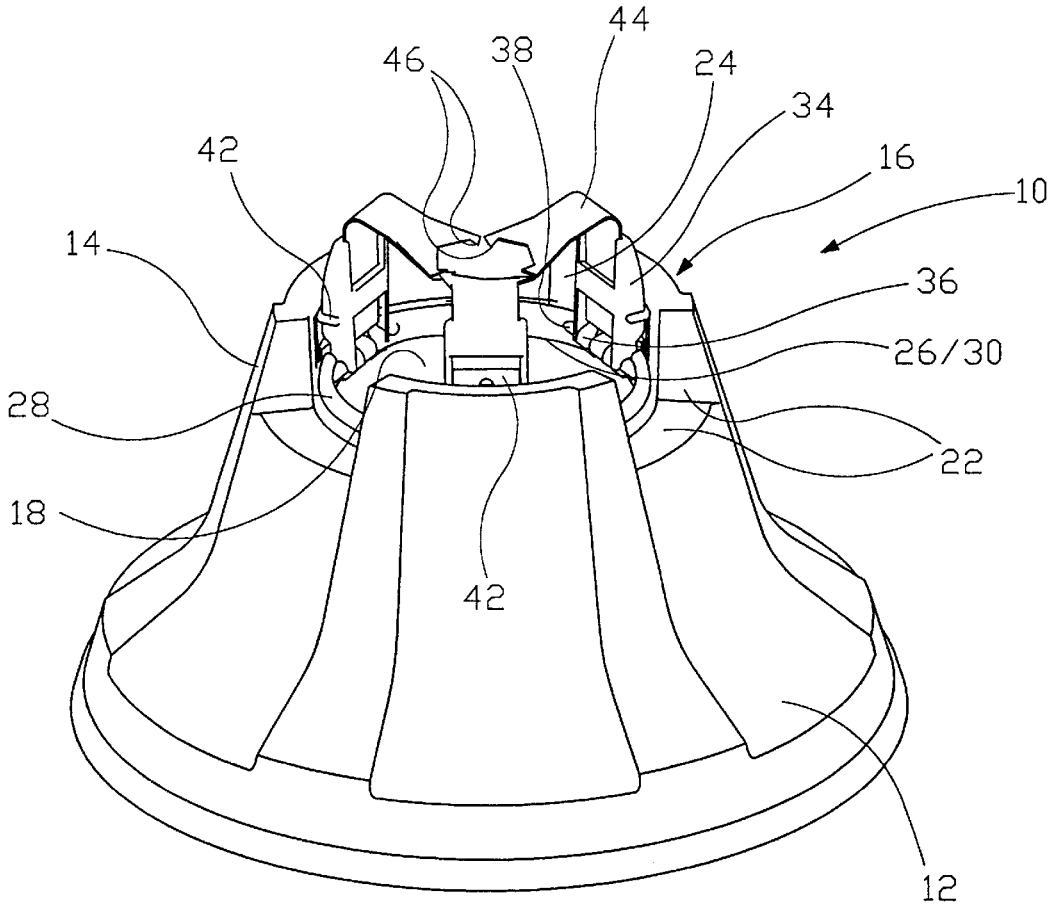
FIG. 1 shows a perspective view of a base with one particular shape, and where a releasable fastening device is located in an inside opening in the base.
Figure 2:
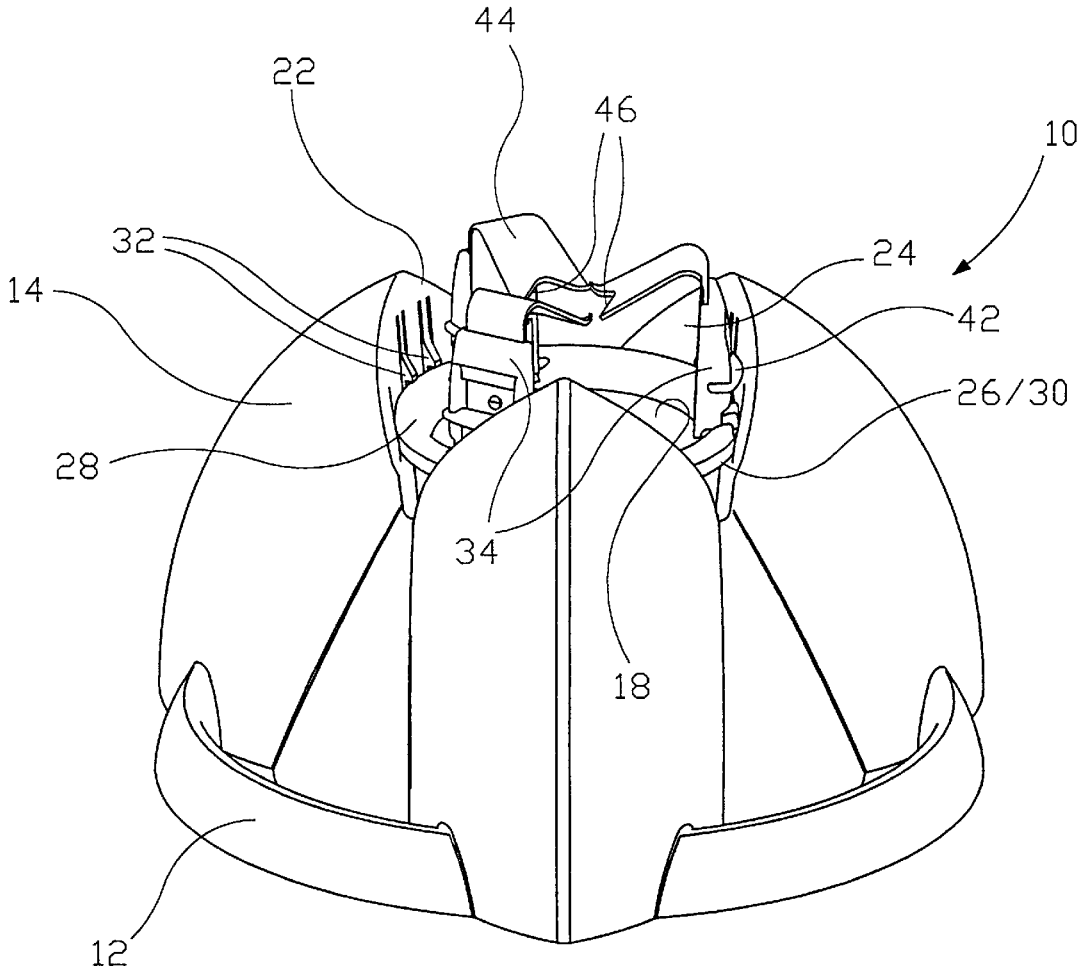
FIG. 2 shows a perspective view of a base that is shaped differently with respect to FIG. 1, and where a releasable fastening device is located in an inside opening in the base.
Figure 3:
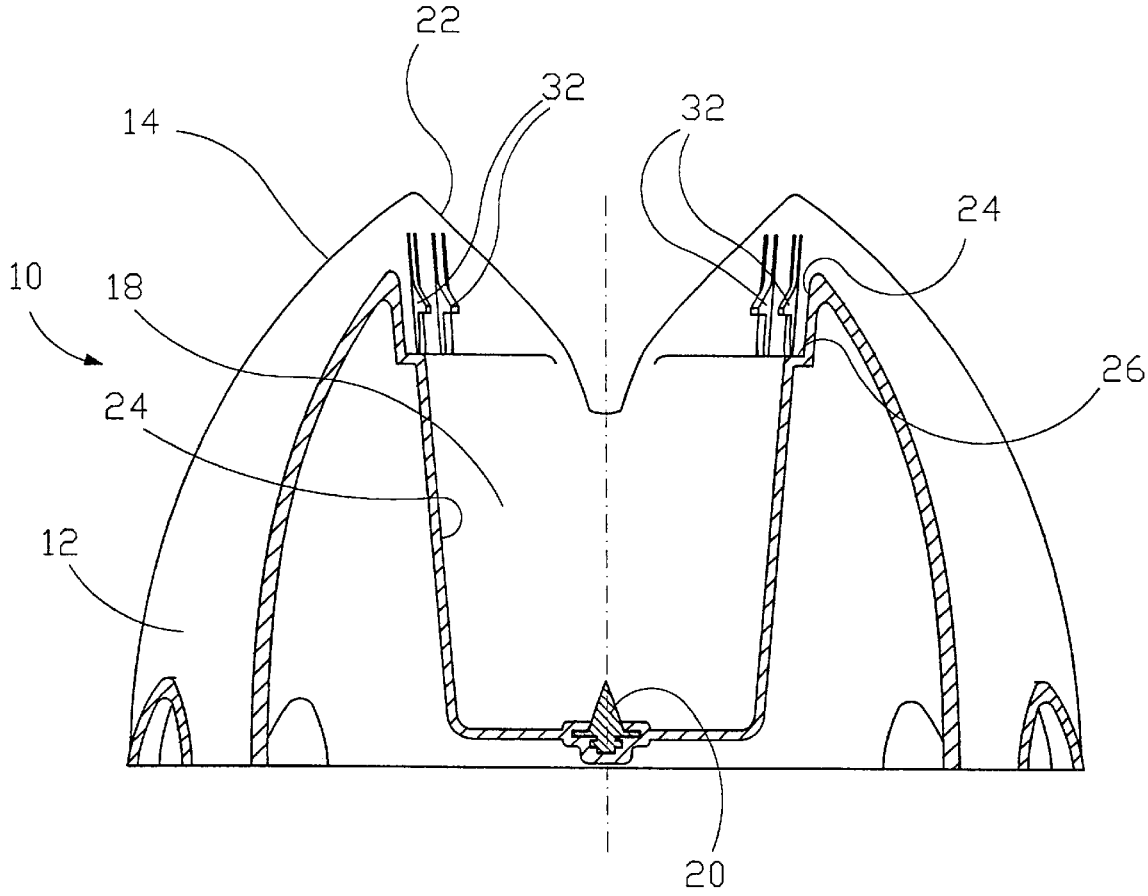
FIG. 3 shows a vertical section through the centre of the base of FIG. 2, but where the annular element with associated clamping parts has been removed.
Figure 4:
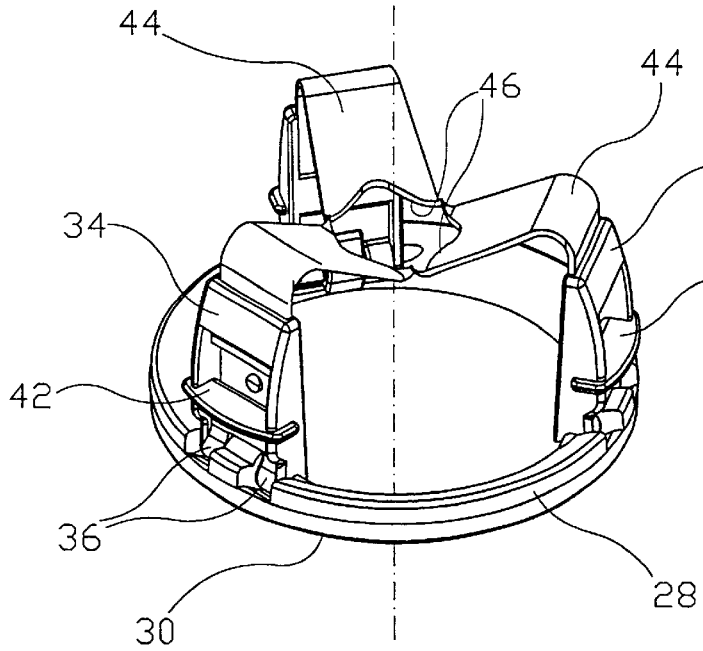
FIG. 4 shows a perspective view of the annular element with associated clamping parts.
Figure 5:
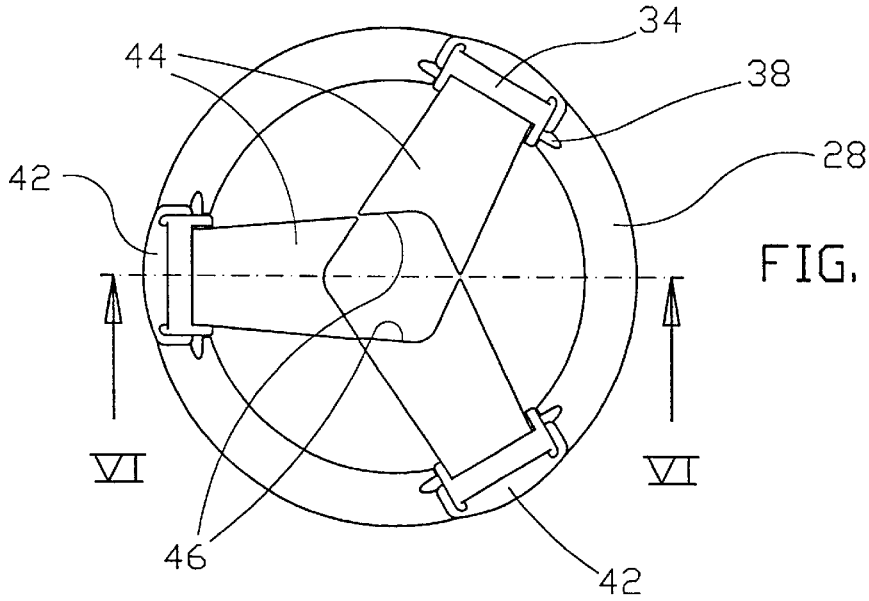
FIG. 5 shows a top view of the same annular element as that shown in FIG. 4, where a cutting line VI—VI has been indicated.
Figure 6:
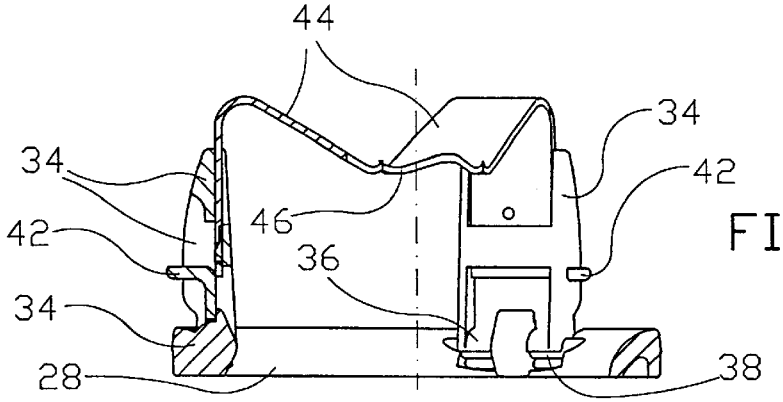
FIG. 6 shows a vertical section through cutting line VI—VI of the.same annular element as that shown in FIGS. 4 and 5.

The lower part 12 of the base 10 acts as a foot for the releasable fastening device, while the upper part 14 of the base 10 contains the releasable fastening device. FIGS. 1 and 2 show two different external shapes of the base 10. FIG. 1 shows an upper-part 14 shaped as a collar 16, while FIG. 2 has a collar-less upper part 14 provided with bevels that merge evenly with lower part 12 and give a uniform exterior.

Both base designs have a not through-going opening 18 internally, which opening is cone-shaped towards the bottom of the base, where a centring point 20 is affixed. Alternatively, the opening 18 may be through-going, where the centring point 20 may e.g. be attached to a hoop or a rod in the lower part of the opening 18. In both designs, the upper part 14 has through-going recesses 22 in the wall 24. In addition, the wall 24 is designed with a circular and horizontal abutment surface 26 on which is placed a separate and matching annular element 28.

On the underside, the annular element 28 is provided with a corresponding abutment surface 30 that bears on the abutment surface 26, which has the effect of allowing the annular element 28 to be rotated about the centreline of the opening 18. The annular element 28 is attached to the wall 24 by use of a snap-in device 32 that keeps the annular element 28 clamped in the axial direction of the opening 18.

To the annular element 28 is rotatably attached three clamping parts 34 that correspond to an identical number of recesses 22 in the wall 24. Each clamping part 34 is hinged to the annular element 28 by means of a snap-in device 36 that encloses a shaft 38 that is attached to the annular element 28, so that the clamping parts 34 may be rotated in towards the centre of the opening 18.

After fastening an object 40, each clamping part 34 abuts the inside of the wall 24 in order to keep the object 40 clamped in the sideways direction. Each clamping part 34 is therefore equipped with an integrally cast or affixed exterior abutment surface lug 42 that abuts the inside of the wall 24.

Figure 7:
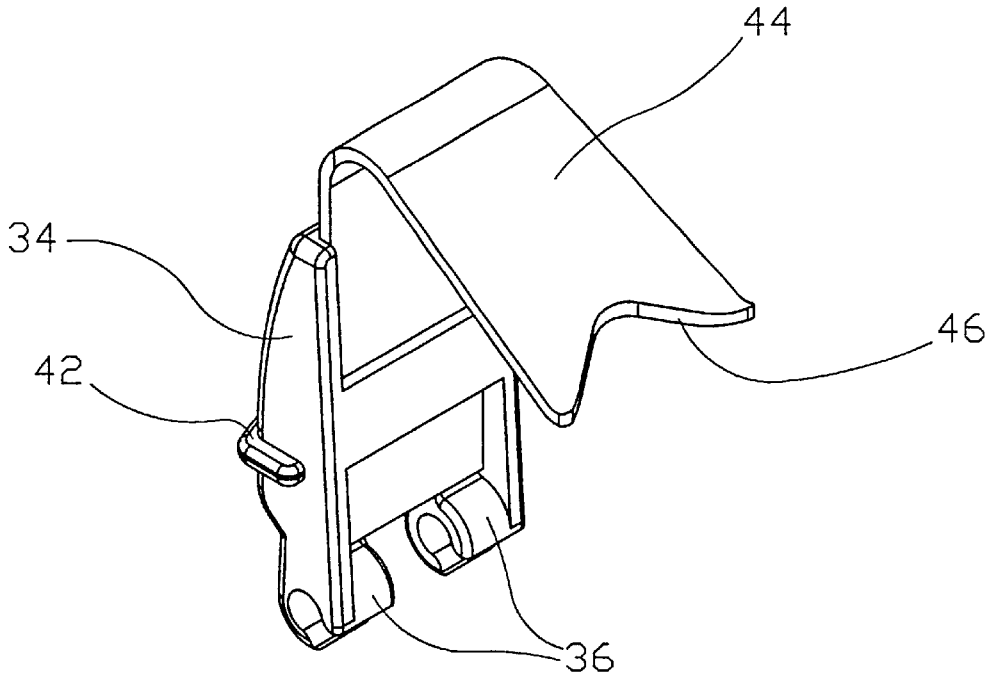
FIG.7 shows a perspective view of a clamping part where the associated resilient portion is attached to this by a snap-in locking device.
Figure 8:
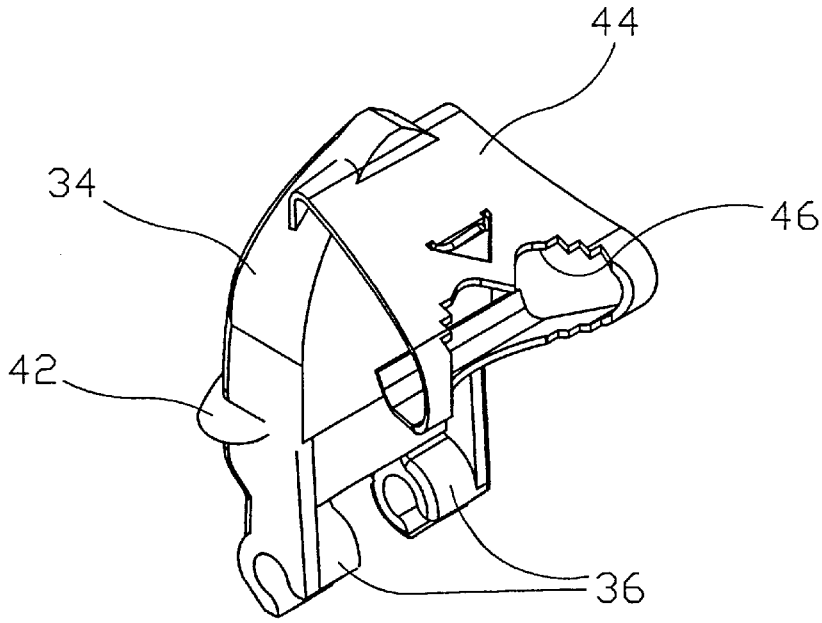
FIG. 8 shows a perspective view of a corresponding clamping part to that shown in FIG. 7, but where the associated resilient portion is integrally cast in the clamping part.
Figure 9:
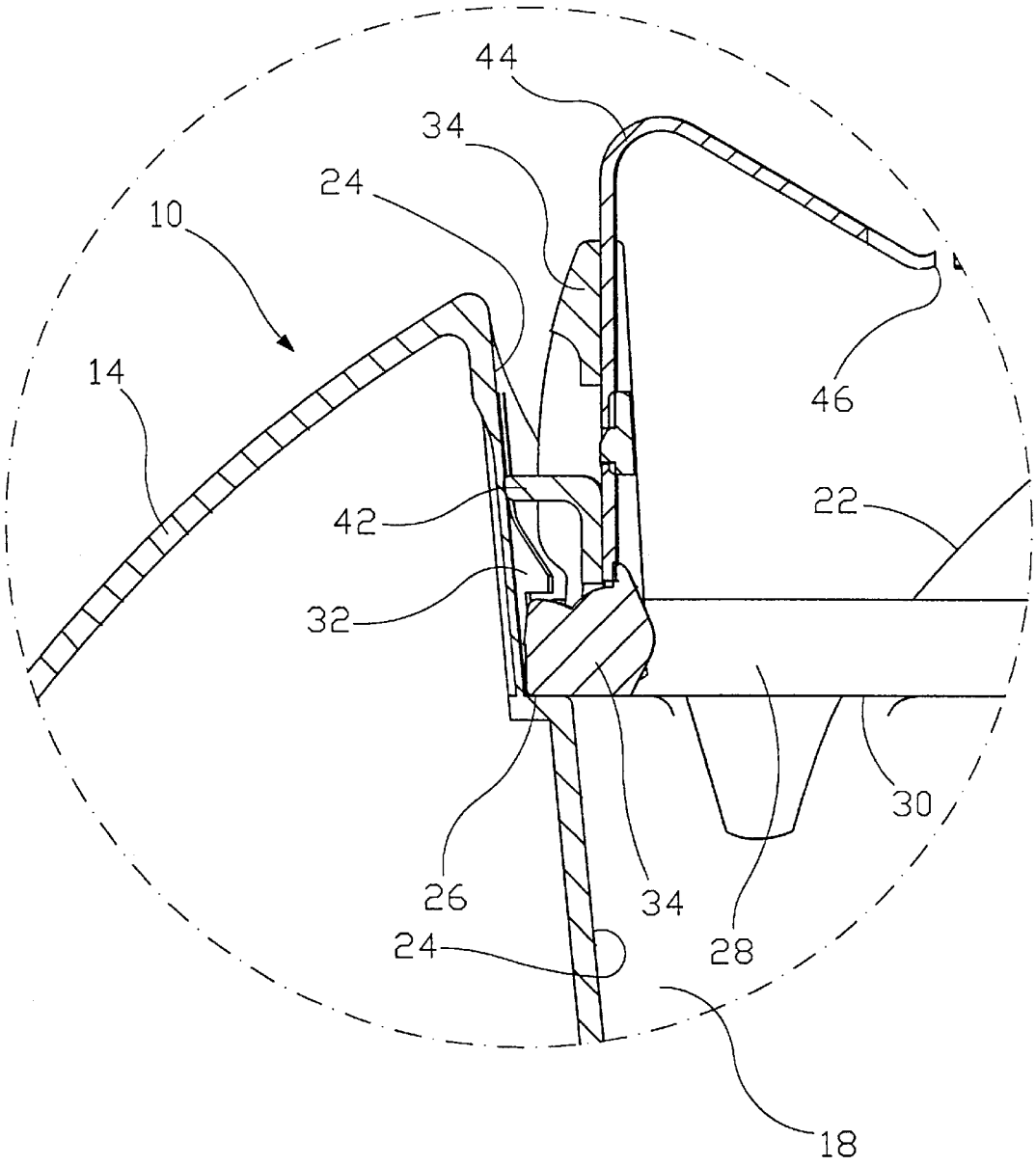
FIG. 9 shows a cutout of the vertical section shown in FIG. 3, but where the cutout also shows the annular element with associated clamping part and resilient portion placed on a horizontal abutment surface in the base opening.

The upper end of each clamping part 34 is connected to a resilient portion 44. The resilient portion 44 may be integrally cast in the clamping part 34, cf. FIG. 8, or it may be attached to this by means of a snap-in type device, cf. FIG. 7. The free end of the resilient portion 44 is shaped with a suitable nose part 46 in the form of points,teeth, barbs or any other suitable formations. The nose part 46 projects inwardly towards the centreline of the opening 18 and is forced in towards the object 40.

When fastening the object 40, this is inserted into the opening 18 between the resilient portions 44, cf. FIGS. 10 *a* and *b*, whereupon the lower end of the object 40 is held in place e.g. by a centring point 20 at the bottom of the base 10. For release, the object 40 and the annular element 28 are rotated about the longitudinal axis of the opening 18 as shown with arrows in FIG. 10*c*. When the clamping parts 34 align with the recesses 22 in the wall 24, each of the abutment surface lugs lose their point of abutment, and each clamping part 34 loosens from the object 40 and falls outwards through the recesses 22, cf. FIG. 10*d*. The object 40 is then pulled out of the opening 18 in the base 10 and removed.

FIGS. 11, 12*a*, 12*b* and 13 show another example of an embodiment of the invention, where the base 10 is equipped with only one through-going recess 22 in the wall 24, and the annular element 28 is therefore only equipped with one corresponding clamping part 34. In this case, the clamping part 34 in its entirety forms a resilient portion 44 that is attached to or forms a part of the annular element 28. The clamping part 34 may as an example consist of a steel spring that is fixed and non-rotatably attached to the annular element 28, but where the clamping part 34 may, due to its spring action, move in the radial direction of the opening 18, and thereby go through a hinge-like movement. The clamping part 34 is provided with an external abutment surface lug 42 that abuts the inside of the wall 24 and clamps an object 40 such as a candle, in the sideways direction. Meanwhile, the abutment surface lug 42 is also shaped as a point 48 that may, after fastening in the base 10, slide in a corresponding groove 50 in the wall 24 and keep the annular element 28 and the object 40 clamped in the direction of the longitudinal axis of the opening 18. The free end of the resilient portion 44 is formed with a projecting and pointed nose part 46 that projects inwardly towards the centreline of the opening 18 and is forced in towards the object 40 and keeps this clamped. Correspondingly, the underside of the annular element 28 is provided with an abutment surface 30 that bears on a corresponding abutment surface 26 at the bottom of the base 10. Fastening and release of the object 40 is essentially carried out in the same manner as that described in the first example of an embodiment.

What is claimed is:

1. A releasable fastening device for an object (40), the fastening area of which is bar-shaped and has a cross section with a round or non-round peripheral shape, characterized in that the fastening device constitutes a separate annular element (28) arranged in a base (10) provided with an inside opening (18) and a surrounding wall (24), where the wall (24) is equipped with one or several recesses or enlarged portions (22) in the wall, and where the inside of the wall (24) is designed with a preferably circular and horizontal abutment surface (26), on which abutment surface (26) is placed the annular element (28), the annular element (28) being rotatably arranged in the opening (18), preferably by the annular element (28) being rotatable about the centreline of the opening (18), and where one or several clamping parts (34) are attached along the periphery of the annular element (28), the number and mutual angular spacing of which clamping parts (34) coincide with the one or several recesses or enlarged portions (22) of the wall (24), and where each clamping part (34) is rotatable or resilient in the radial direction of the opening (18), each clamping part (34) being equipped with a nose part (46) that projects inwardly towards the centre of the opening (18).

2. The releasable fastening device according to claim 1, characterized in that the opening (18) is preferably cylindrical or conical.

3. Releasable fastening device according to claim 2, characterized in that a centring device such as a centring point (20) is placed below the annular element (28), possibly at the bottom of the opening (18).

4. Releasable fastening device according to claim 1, characterized in that the annular element (28) is locked to the base (10) in the longitudinal direction of the opening (18).

5. Releasable fastening device according to claim 1, characterized in that each clamping part (34) is provided with an integrally cast or affixed external abutment surface lug (42).

6. Releasable fastening device according to claim 1, characterized in that each clamping part (34) comprised in part or wholly of a resilient portion (44).

7. Releasable fastening device according to claim 1, characterized in that, said one or several clamping parts (34) may be rotatably or non-rotatably attached to the annular element (28).

8. Releasable fastening device according to claim 1, characterized in that a nose part (46) at the free end of said one or several clamping parts (34) is preferably formed with points, teeth, barbs or similar formations.

9. Releasable fastening device according to claim 1, characterized in that a centring device such as a centring point (20) is placed below the annular element (28), possibly at the bottom of the opening (18).

* * * * *